US010595565B2

(12) United States Patent
Hu et al.

(10) Patent No.: US 10,595,565 B2
(45) Date of Patent: Mar. 24, 2020

(54) ELECTRONIC CIGARETTE

(71) Applicant: Shenzhen First Union Technology Co., Ltd., Shenzhen, Guangdong Province (CN)

(72) Inventors: Shuyun Hu, Shenzhen (CN); Yonghai Li, Shenzhen (CN); Zhongli Xu, Shenzhen (CN)

(73) Assignee: Shenzhen First Union Technology Co., Ltd. (CN)

( * ) Notice: Subject to any disclaimer, the term of this patent is extended or adjusted under 35 U.S.C. 154(b) by 158 days.

(21) Appl. No.: 15/796,843

(22) Filed: Oct. 29, 2017

(65) Prior Publication Data

US 2018/0116288 A1 May 3, 2018

(30) Foreign Application Priority Data

Oct. 31, 2016 (CN) ..... 2016 2 1189118 U

(51) Int. Cl.
*A24F 47/00* (2020.01)
*H05B 3/46* (2006.01)

(52) U.S. Cl.
CPC ..... *A24F 47/008* (2013.01); *H05B 3/46* (2013.01)

(58) Field of Classification Search
CPC ..... A24F 47/008
See application file for complete search history.

(56) References Cited

U.S. PATENT DOCUMENTS 9,717,277 B2 * 8/2017 Mironov ..... A24F 47/008
9,820,512 B2 * 11/2017 Mironov ..... A24F 47/008
2012/0234315 A1 * 9/2012 Li ..... A24F 47/008 128/200.21
2013/0319438 A1 12/2013 Liu
2014/0366898 A1 12/2014 Monsees et al.
2015/0245669 A1 * 9/2015 Cadieux ..... A61M 15/06 131/329
2017/0215481 A1 * 8/2017 Li ..... H05B 3/42
(Continued)

FOREIGN PATENT DOCUMENTS

CN 105962419 A 9/2016
EP 2444112 A1 4/2012
(Continued)

*Primary Examiner* — James Harvey

(74) *Attorney, Agent, or Firm* — PROI Intellectual Property US

(57) ABSTRACT

An exemplary electronic cigarette includes a power supply and an atomizer. The atomizer is connected with the power supply via a detachable connecting structure. The power supply has a connecting end connecting with the atomizer. The power supply includes an electromagnetic induction coil at the connecting end. The atomizer includes a housing, a liquid chamber arranged in the housing, and a metallic element. The metallic element is capable of generating heat in an alternating magnetic field. The liquid chamber defines an opening facing the power supply. The atomizer further includes a liquid storing element arranged in the opening. The liquid storing element is capable of storing tobacco liquid, and preventing tobacco liquid in the liquid chamber from flowing out. The metallic element abuts against the liquid storing element. The metallic element is configured for heating the tobacco liquid absorbed in the liquid storing element to form aerosol.

9 Claims, 4 Drawing Sheets

(56) References Cited

U.S. PATENT DOCUMENTS

| | | | | |
|---|---|---|---|---|
| 2018/0070639 | A1* | 3/2018 | Chen | A24F 47/008 |
| 2018/0116288 | A1* | 5/2018 | Hu | H05B 3/46 |
| 2018/0184716 | A1* | 7/2018 | Song | A24F 47/008 |
| 2018/0325179 | A1* | 11/2018 | Li | A24F 47/008 |
| 2019/0124987 | A1* | 5/2019 | Wu | H05B 6/36 |

FOREIGN PATENT DOCUMENTS

| | | | |
|---|---|---|---|
| WO | 2015177043 | A1 | 11/2015 |
| WO | 2017001818 | A1 | 1/2017 |
| WO | 2017191176 | A1 | 11/2017 |

* cited by examiner

ELECTRONIC CIGARETTE

CROSS REFERENCE TO RELATED APPLICATIONS

The present application claims priority to Chinese Patent Application CN 2016 211 891 18.4 filed on Oct. 31, 2016.

TECHNICAL FIELD

The present disclosure relates to smoking sets, and particularly, to an electronic cigarette.

BACKGROUND

An electronic cigarette also named a simulated cigarette, is a substitute of a cigarette. Electronic cigarettes have become more and more popular because of a lot of advantages. For example, electronic cigarettes are less harmful to human body, and do not generate secondhand smoke and fire. The electronic cigarette will not cause fire hazard.

An electronic cigarette on the market includes a power supply and an atomizer, and the atomizer and the power supply are connected to form an electronic cigarette for smoking. Tobacco liquid and a heating wire assembly are provided in the atomizer, and the heating wire assembly is configured for atomizing the tobacco liquid. After the atomizer and the power supply are connected, a connecting electrode of the power supply is connected with a connecting electrode of the atomizer, so that the power supply provides the heating wire assembly power, and the heating wire assembly heats the tobacco liquid to vaporize.

In related art, a nickel chromium heating wire is used to heat tobacco liquid to form aerosol. Generally, the heating wire is connected with a wire via soldering. However, a soldering point has a relatively short life span, and become broken easily due to oxidation. The soldering point has a weak stability, and a difference of contact resistances between the soldering points is large.

SUMMARY

An exemplary electronic cigarette includes a power supply and an atomizer. The atomizer is connected with the power supply via a detachable connecting structure. The power supply has a connecting end connecting with the atomizer. The power supply includes an electromagnetic induction coil at the connecting end. The atomizer includes a housing, a liquid chamber arranged in the housing, and a metallic element. The metallic element is capable of generating heat in an alternating magnetic field. The liquid chamber defines an opening facing the power supply. The atomizer further includes a liquid storing element arranged in the opening. The liquid storing element is capable of storing tobacco liquid, and preventing tobacco liquid in the liquid chamber from flowing out. The metallic element abuts against the liquid storing element. The metallic element is configured for heating the tobacco liquid absorbed in the liquid storing element to form aerosol.

DETAILED DESCRIPTION

The present disclosure will be described in detail as follows in view of several embodiments and the accompanying drawings.

Figure 1:
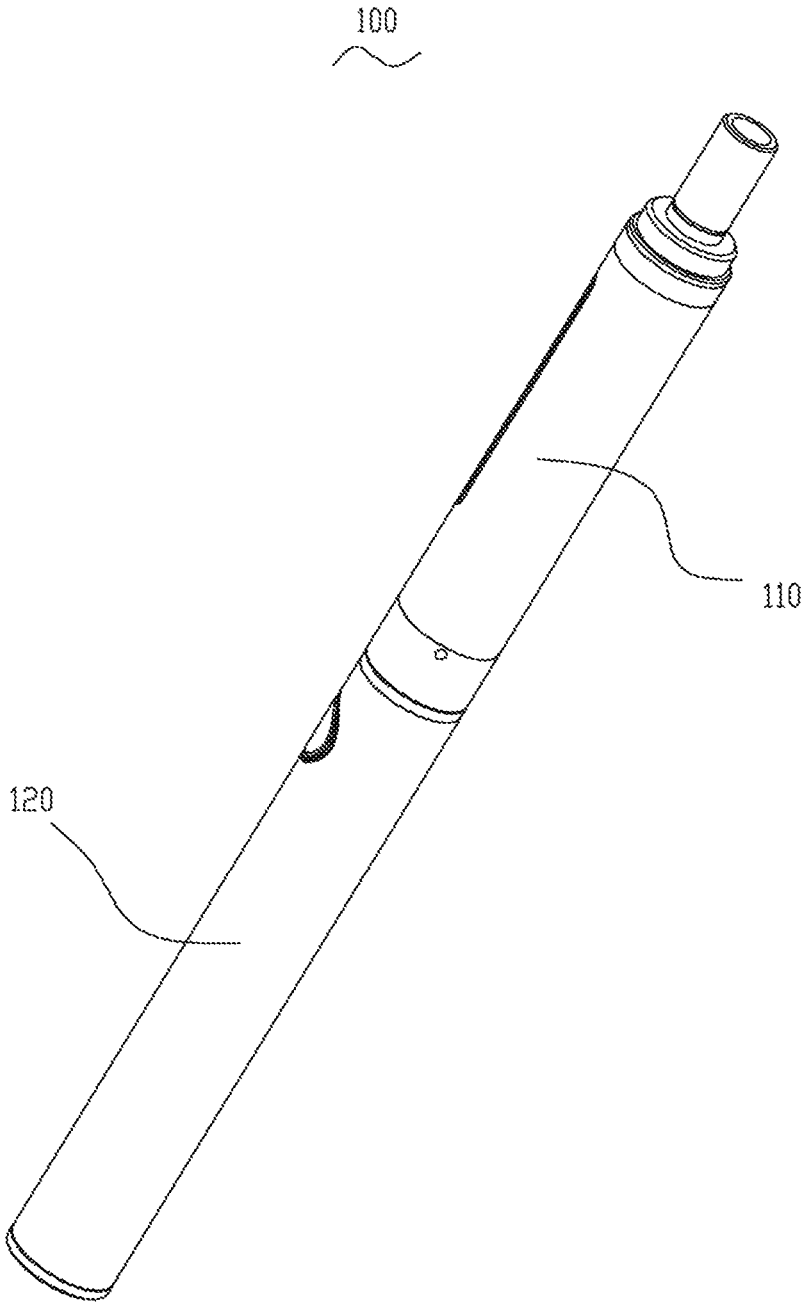
FIG. 1 is a perspective view of an electronic cigarette.
Figure 2:
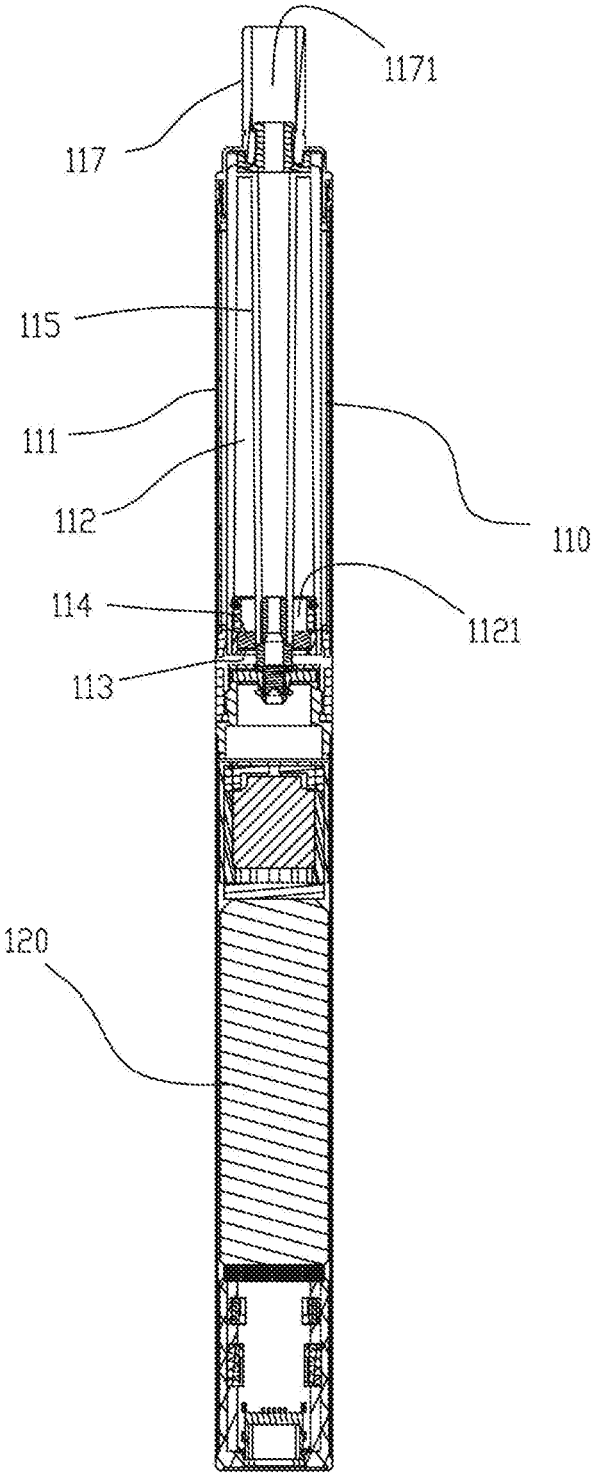
FIG. 2 is a cross-sectional view of the electronic cigarette of FIG. 1.

Referring to FIGS. 1-2, an electronic cigarette 100 is shown. The electronic cigarette 100 includes an atomizer 110 and a power supply 120. The atomizer 110 and the power supply 120 are connected via a screw thread structure. The power supply 120 is configured for supplying the atomizer 110 power. Also referring to FIG. 3, an electromagnetic induction coil 121 is provided at a connecting end of the power supply 120 connecting with the atomizer 110. The atomizer 110 includes a housing 111, a liquid chamber 112 defined in the housing 111, and a metallic element 113. The metallic element 113 is capable of generating heating due to electromagnetic induction. The liquid chamber 112 defines an opening 1121 facing the power supply 120. A liquid storing element 114 is arranged in the opening 1121. The liquid storing element 114 is capable of storing tobacco liquid, and preventing the tobacco liquid from flowing out from the liquid chamber. The metallic element 113 abuts against the liquid storing element 114. The metallic element 113 heats the tobacco liquid absorbed in the liquid storing element 114 to form aerosol. The detachable connecting structure between the power supply 120 and the atomizer 110 may be a screw thread structure, a snap-fit structure, or a magnetic attraction structure.

Figure 3:
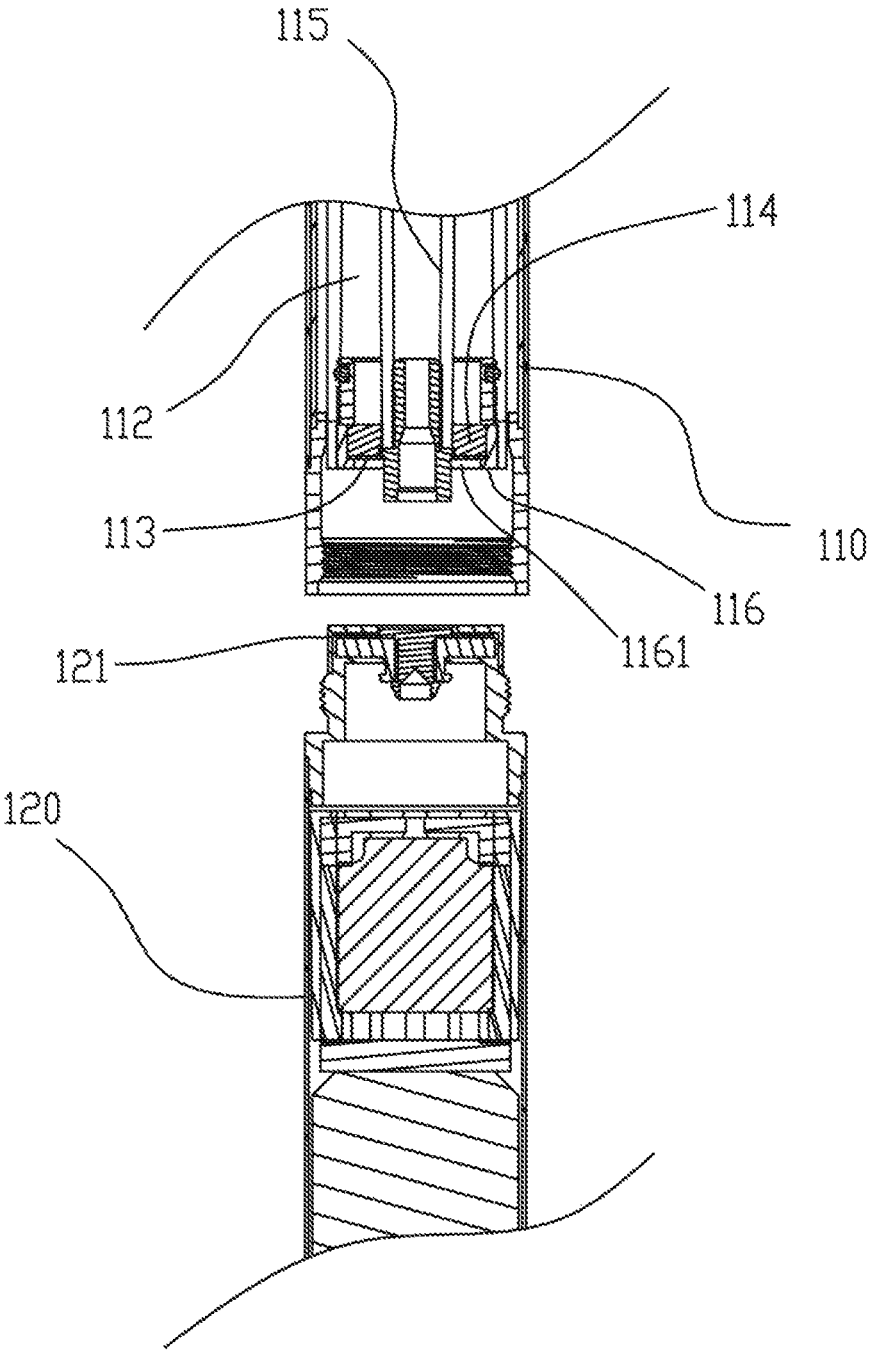
FIG. 3 is a schematic view of a connecting part of FIG. 2.

Referring to FIGS. 2-3, an air pipe 115 and a fixing element 116 are provided in the housing 111. The air pipe 115 allows the aerosol to flow out. The fixing element 116 is configured for fixing the liquid storing element 114 and the metallic element 113. Both the liquid storing element 114 and the metallic element 113 nest the air pipe 115. The metallic element 113 abuts against an outer surface of the liquid storing element 114. The fixing element 116 is connected in the opening 1121. The fixing element 116 is made of magnetic permeable material. The fixing element 116 defines a through hole 1161 allowing the aerosol to pass through. In the present embodiment, the through hole 1161 is configured to allow the aerosol, which is formed by the metallic element, to pass through.

In the present embodiment, the liquid storing element 114 is made of liquid conducting cotton, glass fiber material, or micro-porous ceramic material. The metallic element 113 is processed to a porous structure, which can absorb tobacco liquid easily. For example, the metallic element 113 is a net-like structure knitted by micro-porous foaming metal, porous metallic piece or metallic wire.

Referring to FIG. 2, the housing 111 is further provided with a mouthpiece 117. The mouthpiece 117 defines an air outlet 1171. The mouthpiece 117 is arranged at an end of the housing 111, and the air outlet 1171 is in communication with the air pipe 115.

Figure 4:
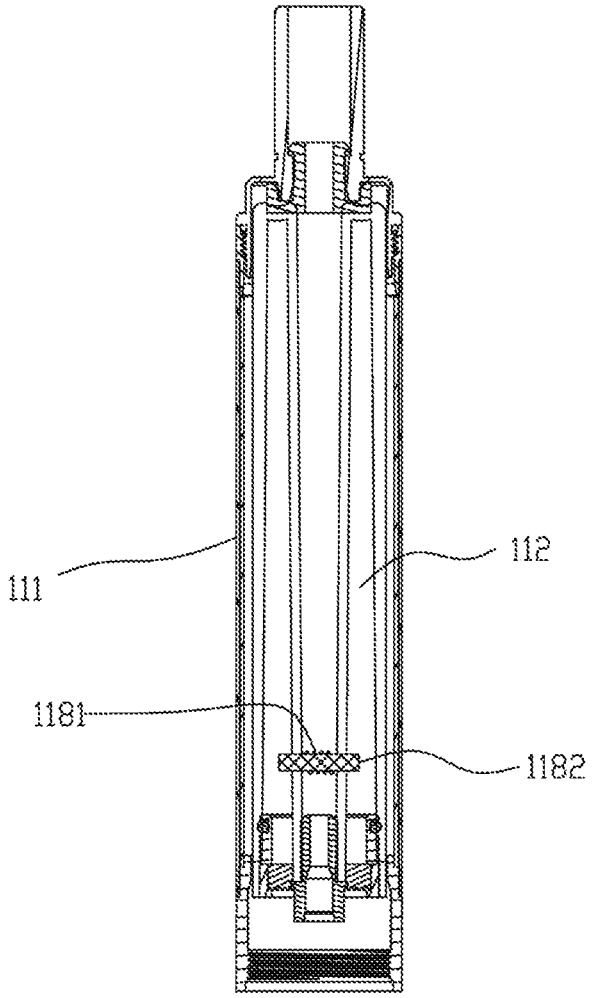
FIG. 4 is another structural view of an atomizer.

Referring to FIG. 4, in other embodiments, a resistance heating element 1181 and a liquid conducting element 1182 are further provided in the housing 111. Two ends of the liquid conducting element 1182 insert into the liquid chamber 112, and absorb tobacco liquid. The resistance heating element 1181 is in contact with the liquid conducting element 1182. After the power supply 120 is connected with the atomizer 110, the power supply 120 is configured for supplying the resistance heating element 1181 power. The liquid conducting element 1182 may be made of glass fiber material or ceramic material.

In the present embodiment, the housing 111 may be transparent as a whole or partially transparent. Thus, a quantity of tobacco liquid in the liquid chamber 112 can be seen clearly through the housing 111. Accordingly, it is prevented that the atomizing element is burnt after the tobacco liquid is used up.

In the present embodiment, the power supply 120 includes the electromagnetic induction coil 121, and the atomizer 110 includes the metallic element 113, which is capable of generating heat in response to an alternating magnetic field. The metallic element 113 abuts against the liquid storing element 114, and the liquid storing element 114 absorbs tobacco liquid. Accordingly, after the atomizer 110 is connected to the power supply 120, when the electromagnetic induction coil 121 generates an alternating magnetic field, the metallic element 113 generates heat in response to the alternating magnetic field, and heats the tobacco liquid in the liquid storing element 114 to form aerosol for smoking. Comparing with the resistance heating manner in related art, there is no contact resistance caused by soldering points. Accordingly, the present electronic cigarette has a longer life span, is more effective in heat transmission, and quicker in generating aerosol.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An electronic cigarette, comprising:

a power supply; and an atomizer, the atomizer being connected with the power supply via a detachable connecting structure, the power supply having a connecting end connecting with the atomizer, the power supply comprising an electromagnetic induction coil at the connecting end, the atomizer comprising a housing, a liquid chamber arranged in the housing, and a metallic element, the metallic element being capable of generating heat in an alternating magnetic field, the liquid chamber defining an opening facing the power supply, the atomizer further comprising a liquid storing element arranged in the opening, the liquid storing element being capable of storing tobacco liquid, and preventing tobacco liquid in the liquid chamber from flowing out, the metallic element abutting against the liquid storing element, the metallic element being configured for heating the tobacco liquid absorbed in the liquid storing element to form aerosol;

wherein the electronic cigarette further comprises an air pipe in the housing allowing the aerosol to flow out, both the liquid storing element and the metallic element nest the air pipe, the metallic element abuts against an outer surface of the liquid storing element.

2. The electronic cigarette according to claim 1, wherein the housing is transparent as a whole or partially transparent.

3. The electronic cigarette according to claim 1, further comprising a fixing element, wherein the fixing element is configured for fixing the liquid storing element and the metallic element, and the fixing element defines a through hole allowing the aerosol to pass through.

4. The electronic cigarette according to claim 1, wherein the metallic element comprises a porous structure suitable for absorbing tobacco liquid.

5. The electronic cigarette according to claim 4, wherein the metallic element comprises a net-like structure knitted by micro-porous foaming metal, porous metallic piece or metallic wire.

6. The electronic cigarette according to claim 1, wherein the liquid storing element is made of liquid conducting cotton, glass fiber material, or micro-porous ceramic material.

7. The electronic cigarette according to claim 1, further comprising a mouthpiece connected with the housing, wherein the mouthpiece defines an air outlet.

8. The electronic cigarette according to claim 1, wherein the detachable connecting structure between the power supply and the atomizer is a screw thread structure, a snap-fit structure, or a magnetic attraction structure.

9. The electronic cigarette according to claim 1, wherein the electronic cigarette further comprises a resistance heating element and a liquid conducting element in the housing, at least one end of the liquid conducting element insert into the liquid chamber for absorbing tobacco liquid, the resistance heating element is in contact with the liquid conducting element, and after the power supply is connected to the atomizer, the power supply is configured for supplying the resistance heating element power.

* * * * *